United States Patent [19]

Smith

[11] 3,968,931

[45] July 13, 1976

[54] PRESSURE JET ATOMISER

[75] Inventor: Donald A. Smith, Haddam, Conn.

[73] Assignee: Combustion Engineering, Inc., Windsor, Conn.

[22] Filed: Oct. 6, 1975

[21] Appl. No.: 619,975

[52] U.S. Cl. ..... 239/125; 239/467; 239/472; 239/601

[51] Int. Cl.[2] ..... B05B 9/00; B05B 1/34

[58] Field of Search ..... 239/461–463, 239/467, 472, 500, 124, 125, 120, 119, 127, 601

[56] References Cited

UNITED STATES PATENTS

| | | | |
|---|---|---|---|
| 2,037,645 | 4/1936 | Vroom et al. | 239/125 |
| 2,315,172 | 3/1943 | Voorheis | 239/125 |
| 2,323,001 | 6/1943 | Bargeboer | 239/125 |
| 2,373,707 | 4/1945 | Peabody | 239/125 |
| 2,428,748 | 10/1947 | Barz | 239/472 |
| 2,566,532 | 9/1951 | Olson | 239/125 |
| 3,019,990 | 2/1962 | Campbell | 239/125 |
| 3,726,482 | 4/1973 | Heinrichs | 239/467 |

FOREIGN PATENTS OR APPLICATIONS

| | | | |
|---|---|---|---|
| 1,156,742 | 12/1957 | France | 239/601 |

*Primary Examiner*—Robert S. Ward, Jr.

[57] ABSTRACT

A pressure jet atomiser of the centrifugal swirl type wherein a forced vortex is gradually accelerated, by being directed through a smoothly converging passage, and is thereafter refined and thinned. Refining of the vortex occurs in a constant diameter nozzle throat section and thinning is achieved by passage through a smooth diverging diffuser downstream of the throat. A constant spray angle for the thinned vortex is achieved by providing the diffuser with an abrupt set-back.

25 Claims, 1 Drawing Figure

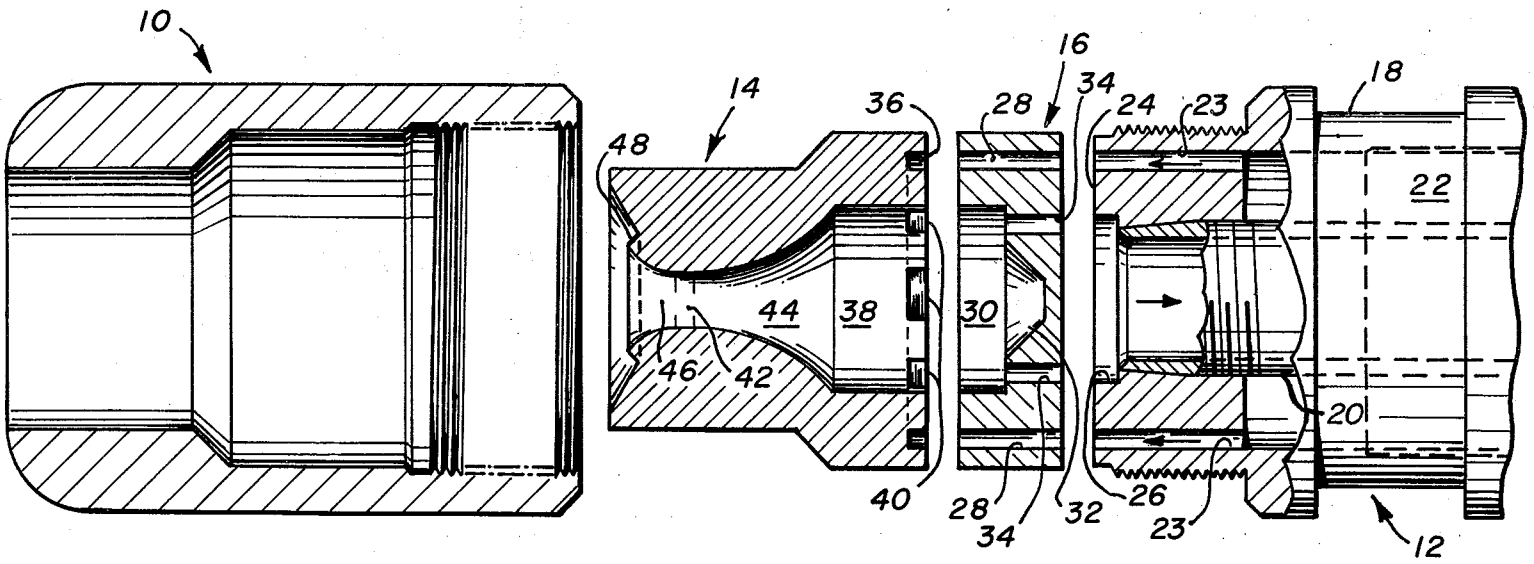
12
18
22
20
23
23
24
26
34
32
16
28
30
28
34
36
40
38
14
44
42
46
48
10

PRESSURE JET ATOMISER

BACKGROUND OF THE INVENTION

1. Field of the Invention

The present invention relates to the atomisation of liquid fuels for combustion. More specifically, this invention is directed to mechanical atomisers and particularly to a novel and improved pressure jet atomiser of the centrifugal swirl type. Accordingly, the general objects of the present invention are to provide novel and improved methods and apparatus of such character.

2. Description of the Prior Art

As is well known, liquid fuels are subjected to atomisation in order to cause a greatly increased surface area of the liquid to be exposed to the air; i.e., to promote intimate mixing of the liquid fuel and the gases needed to support combustion. In effecting the atomisation of a liquid fuel, force is applied to the liquid to set it in motion. The moving liquid should preferably be ejected into a combustion chamber as an attenuated film which is disrupted into filaments. The filaments thereafter disintegrate into small particles or fragments which, as a result of the surface tension of the liquid itself, assume spherical droplet form whereby an atomised spray results. The breakup of the attenuated film into filaments may be accomplished by the application of outside forces or as a result of kinetic energy in the liquid derived from the initial force which promoted its flow.

A number of different methods of atomisation are known in the prior art. The prior art atomisers include steam atomisers, air atomisers, Weir atomisers; also known as drooling atomisers; mechanical atomisers; wherein a rotating cup-type element is employed; and pressure jet atomisers. Pressure jet atomisers may be either of the plain orifice or centrifugal swirl type. A pressure jet atomiser of the centrifugal swirl type is disclosed in U.S. Pat. No. 2,373,707.

Pressure jet atomisers of the centrifugal swirl type are used extensively in the oil guns of boilers for steam generators of the types employed by electrical utilities and used on large marine vessels. In the typical prior art centrifugal swirl type atomiser, the liquid fuel under pressure is fed into a swirl or vortex chamber through tangentially disposed slots. The rotating mass of liquid in the swirl chamber is forced toward a discharge orifice; the discharge orifice having a diameter which is small when compared to the diameter of the swirl chamber. As a result of the translational force which urges the liquid axially toward the discharge orifice and the centrifugal force which urges the liquid against the restricting boundary walls of the swirl chamber and orifice, the liquid is ejected from the orifice as a rapidly thinning divergently conical film. This film is, in theory, inherently unstable and will break up into spherical droplets; these spherical droplets defining the desired spray.

Prior art centrifugal swirl type pressure jet atomisers have been characterized by a number of inherent deficiencies. The most significant of these deficiencies has resided in an inability of the prior art devices to achieve the desired atomisation efficiency over a wide range of fuel flows. Thus, in typical prior art centrifugal swirl type atomisers, the liquid film which emerges from the discharge orifice increases in thickness in an inverse ratio with flow. As the fuel film thickness increases, of course, there is greater resistance to rupture. As a closely allied problem, prior art swirl-type atomisers have also been characterized by instability with the spray angle varying substantially with pressure. Restated, the prior art swirl-type atomisers have been characterized by an unstable spray pattern; i.e., a spray pattern which tends to wander.

SUMMARY OF THE INVENTION

The present invention overcomes the above briefly described and other deficiencies and disadvantages of the prior art by providing a novel and improved mechanical atomiser of the centrifugal swirl type. In accordance with the invention a swirl-type atomiser has a plurality of tangential slots which discharge a pressurized fuel into a vortex chamber which, when compared to the prior art, is significantly enlarged. The vortex chamber is provided with a vortex stabilizer and may be provided with a liquid return. The vortex chamber is also characterized by gradual contraction to a short straight orifice throat section. The throat section flares to a smooth bell mouth diffuser which terminates in an abrupt angle break.

In operation of the swirl-type atomiser of the present invention the oil delivered to the vortex chamber through the tangential slots forms a stable forced vortex. This forced vortex is caused, by the gradually contracting walls of the vortex chamber, to gradually accelerate with a minimum loss of spin momentum thus raising the sheer stress in the liquid fuel to an extremely high level. The vortex is further refined by the short straight throat section. Finally, as the result of Coanda effect, the fluid remains attached to the walls of the smooth bell-shaped diffuser and thus the vortex expands downstream of the throat section. The abrupt angle break in the diffuser creates a definite point of detachment and thereby results in a stable spray angle. The attachment of the fluid fuel to the wall of the diffuser in combination with the spin momentum of the fuel results in a thin boundary layer and thus in a thin sheet of discharge and high atomisation efficiency.

Return oil may be removed from the inner boundary of the forced vortex through the base of a vortex stabilizer located at the end of the swirl chamber disposed oppositely to the throat. This mode of return further stabilizes the vortex and eliminates the possibility of vortex drilling in the base of the vortex stabilizer.

As will be obvious from the preceding summary, a principal object of the present invention is to increase the swirl number; i.e., the ratio of the angular momentum to the axial momentum of the flowing liquid fuel; of a swirl-type atomiser.

A further object of the present invention is to enhance the stability of operation, and particularly to stabilize the spray angle, of swirl-type atomisers.

Another object of the present invention is to provide a swirl-type atomiser which produces a high degree of atomisation over a wide range of flows.

Yet another object of this invention is to achieve more flow and better atomisation at low pressures when compared to prior art atomisers of similar character.

BRIEF DESCRIPTION OF THE DRAWING

The present invention will be better understood, and its numerous additional objects and advantages will become apparent to those skilled in the art, by reference to the accompanying drawing which is an exploded cross-sectional side elevation view of a preferred embodiment of a swirl-type atomiser in accordance with the invention.

DESCRIPTION OF THE PREFERRED EMBODIMENT

With reference now to the drawing, an atomiser or oil gun tip includes a nozzle cap, indicated generally at 10, and a nozzle body, indicated generally at 12. The nozzle cap 10 and body 12 cooperate to define the housing for the swirl-type atomiser of the present invention. The atomiser, in turn, is formed by a nozzle or swirl chamber defining member, indicated generally at 14, and a back plate-vortex stabilizer member indicated generally at 16.

The nozzle body 12 includes an outer tubular member 18 having an externally threaded end which engages, with the oil gun tip assembled, a cooperating internal thread on nozzle cap 10. Nozzle body 12 also includes an inner tubular member 20 which cooperates with outer member 18 to define an annular supply passage 22 for the oil or other fuel being delivered to the swirl-type atomiser. The inner tubular member or conduit 20 is received, at its downstream end in the direction of fuel supply to the atomiser, in flow passage defining portion 24 of body 12. Portion 24 of body 12 is provided with a circular array of apertures 23 which are in communication, at their upstream ends, with supply passage 22. Portion 24 of body 14 is also provided, in its exposed end, with an axial circular recess which defines, with the body 12 in its normal abutting relationship to plate 16, a collection chamber 26 through which the fuel not ejected from the atomiser is returned to conduit 20 for delivery to a reservoir. A pressure differential is maintained between the inlet and downstream ends of conduit 20 during operation.

The back plate 16 of the atomiser will be sandwiched between nozzle 14 and the end of body 12 with the oil gun assembled; the opposite ends of back plate 16 defining planes which cooperate with similar planar surfaces on the nozzle and body to define leak-proof abutting assembled relationships. Back plate 16 is provided with an outer circular array of passages, as indicated at 28, which register with the apertures 23 in body 12. Member 16 is also provided, in the side which faces nozzle 14, with an axial circular recess or cut-out 30. The cut-out 30 is, at its base, provided with a further axially aligned cup-shaped recess 32. Finally, member 16 may be provided with a further inner circular array of flow passages 34 which provide communication between the base cut-out 30 and chamber 26. Passages 34, when present, are offset radially inwardly from the outer diameter of cut-out 30. While cut-out 30 enhances the vortex stability, the atomiser will function without the cut-out as long as the fuel is injected into a constant diameter section of the swirl chamber of the nozzle. The cup-shaped recess 32 in the base of cut-out 30 stabilizes the vortex formed in the swirl chamber of the nozzle; the recess 32 being in direct communication with the swirl chamber. The manner in which stabilization is achieved will be discussed below.

The nozzle 14 is provided with an annular recess 36 which, with the oil gun assembled, registers with the discharge ends of the outer circular array of passages 28 in back plate member 16. The recess 36, which is formed as a cut-out in the rearwardly disposed face of nozzle 14, thus functions as a manifold in receiving fuel from supply passage 22 via the arrays of passages 23 and 28 respectively in body 12 and plate 16. Fluid communication between the annular manifold 36 and a constant diameter upstream portion 38 of the swirl chamber formed in the nozzle 14 via a plurality of rectangular slots which discharge into chamber portion 38 tangentially. These tangential slots, which are preferably six in number, have a length to hydraulic diameter ratio which is equal to or greater than 2; the length of the slots being defined as the distance included between two parallel surfaces of a slot. Three of the tangential slots are indicated on the drawing at 40. Swirl chamber portion 38 is of constant diameter in the interest of allowing the swirling jets created by the discharge from the tangential slots 40 to merge into a uniform swirling film before being accelerated. It is to be noted that recess 36 and slots 40 may be formed in the face of back plate 16 rather than on nozzle 14 if desired.

The swirl chamber in nozzle 14, downstream of the constant diameter portion 38, is provided with curved walls which smoothly converge to a straight throat section 42; the converging swirl chamber portion being indicated at 44. The straight throat section 42 provides a region for the accelerated film to become stable and of uniform thickness. If the film is not permitted to stabilize; i.e., passed through a region where there will be no further acceleration; there may be undulations on the surface of the film exposed to the vortex air core which could cause premature break-up of the fluid sheet prior to further thinning thereof in a diffuser section of the nozzle. The length of nozzle straight section 42 should be at least one-third of the diameter of such section. Nozzle 14 also includes a smooth bell mouth diffuser section 46 positioned downstream of straight throat section 42. Diffuser section 46 terminates in an abrupt angle break or set-back as indicated at 48. Accordingly, the nozzle portion 14 of the swirl type atomiser of the present invention is characterized by smooth walls between the swirl chamber 38 and the abrupt break 48 of the diffuser wall. Restated, the straight throat section 42 is tangent to convergent section 44 and divergent section 48. The nozzle is also characterized by a ratio of the diameter of the swirl chamber 38 to throat 42 of at least four.

In operation, considering the invention to be employed in the environment of an oil gun for purposes of explanation, oil flows through the outer pipe annulus 22 of the nozzle body 12 and is delivered to the annular manifold 36 in nozzle 14 via the aligned circular arrays of passages 23 and 28. From annular passage 36 the oil passes through the series of tangential slots 40; slots 40 directing the oil flow inwardly to vortex chamber 38 wherein a stable forced vortex is formed. The vortex is stabilized by the cup-shaped recess 32 in back plate 16 by virtue of this recess confining the vortex air core and thus preventing wandering of the vortex. The confining of the air core results from the establishment of a recirculating eddy or eddies in the air or fuel vapor drawn "down" through the core which recirculating flow surrounds and thus stabilizes the position of the core. The stable forced vortex is, as a result of the configuration of the walls of nozzle portion 44, caused to gradually contract whereby the vortex is accelerated with a minimum loss of spin momentum. This acceleration raises the sheer stress in the oil to an extremely high level. The vortex is, as discussed above, further refined by the short straight throat section 42. Due to the well known Coanda effect, the oil film or sheet will have attached to the walls of the nozzle and such attachment will cause the vortex to expand, and simultaneously thin, as the fuel exits from the nozzle via the diffuser section 46. Because of the abrupt set-back 48 which terminates the diffuser, the conical film being ejected from the nozzle will detach from the diffuser at a stable spray angle.

Excess or return oil is removed, via the inner circular array of passages 34, from the inner boundary of the forced vortex; the return oil flowing through the base of the vortex stabilizer. The removal of return oil further stabilizes the vortex and eliminates the possibility of vortex drilling in the base of the vortex stabilizer.

The present invention has been described above in the context of a wide range mechanical atomiser of the pressure jet centrifugal swirl type. As a wide range mechanical atomiser the invention includes means for withdrawing excess oil from the swirl chamber and is characterized by minimal decrease in atomisation efficiency with decreases in flow or pressure. The invention may, however, also be used as a straight mechanical atomiser; i.e., a pressure jet device; without any provision for return flow.

While a preferred embodiment has been shown and described, various modifications and substitutions may be made thereto without departing from the spirit and scope of the invention. Accordingly, it is to be understood that the present invention has been described by way of illustration and not limitation.

What is claimed is:

1. A pressure jet atomiser comprising:

swirl chamber means, said chamber means defining a vortex chamber having a cylindrical shape, said chamber being open at least at a first discharge end;

means for delivering a fluid to be atomised to said vortex chamber, said delivering means discharging the fluid into said chamber tangentially to the chamber wall whereby a forced vortex is formed;

means for accelerating the forced vortex, said accelerating means being connected to the open first end of said cylindrical vortex chamber and having a smooth curved contracting passage therethrough, said passage being coaxial with said chamber whereby the diameter of the forced vortex exiting said chamber is reduced at a decreasing rate;

a diffuser, said diffuser having a smoothly curved wall which diverges away from an extension of the axis of said cylindrical vortex chamber and accelerating means passage; and means defining a nozzle throat, said throat coupling the minimum diameter downstream end of said accelerating means to the minimum diameter upstream end of said diffuser, said throat having a constant diameter, the wall of said throat being tangent to the walls of said accelerating means passage and said diffuser.

2. The apparatus of claim 1 wherein the length of said throat is at least one-third the diameter of said throat whereby the accelerated vortex will become stabilized and of uniform thickness before being thinned in said diffuser.

3. The apparatus of claim 2 wherein the diameter of said throat does not exceed one-fourth the diameter of said vortex chamber.

4. The apparatus of claim 1 wherein the forced vortex has a gaseous core and said apparatus further comprises:

means for stabilizing the foreed vortex, said stabilizing means being in fluid communication with the second end of said cylindrical vortex chamber.

5. The apparatus of claim 4 wherein said stabilizing means comprises:

means for establishing and confining a recirculating flow of gas about said gaseous core adjacent said second end of said vortex chamber.

6. The apparatus of claim 5 wherein said flow establishing and confining means comprises:

a back plate, said back plate forming a closure for the second end of said vortex chamber; and a recess in said back plate, said recess facing and being coaxial with said vortex chamber, said recess having tapering walls and a maximum diameter less than the diameter of said vortex chamber.

7. The apparatus of claim 1 wherein said delivering means comprises:

means defining an annular manifold;

means for transmitting the fluid to be atomised to the interior of said manifold defining means; and a plurality of slots providing fluid communication between the interior of said manifold defining means and said vortex chamber, said slots discharging into said chamber tangentially to the wall thereof.

8. The apparatus of claim 7 wherein said slots have a length to hydraulic diameter ratio of at least 2.

9. The apparatus of claim 7 wherein said transmitting means includes a first circular array of passages which discharge into the manifold formed by said manifold defining means.

10. The apparatus of claim 1 wherein said swirl chamber means, accelerating means, diffuser and throat defining means are integral.

11. The apparatus of claim 10 wherein said delivering means comprises:

means defining an annular manifold;

means for transmitting the fluid to be atomised to the interior of said manifold defining means; and a plurality of slots providing fluid communication between the interior of said manifold defining means and said vortex chamber, said slots discharging into said chamber tangentially to the wall thereof.

12. The apparatus of claim 11 wherein the forced vortex has a gaseous core and said apparatus further comprises:

means for stabilizing the forced vortex, said stabilizing means being in fluid communication with the second end of said cylindrical vortex chamber.

13. The apparatus of claim 12 wherein said stabilizing means comprises:

means for establishing and confining a recirculating flow of gas about said gaseous core adjacent said second end of said vortex chamber.

14. The apparatus of claim 13 wherein said flow establishing and confining means comprises:

a back plate, said back plate forming a closure for the second end of said vortex chamber; and a recess in said back plate, said recess facing and being coaxial with said vortex chamber, said recess having tapering walls and a maximum diameter less than the diameter of said vortex chamber.

15. The apparatus of claim 14 further comprising:

means for removing excess fluid from the inner boundary of the forced vortex in said vortex chamber, said removing means including at least a first flow passage extending through said back plate.

16. The apparatus of claim 15 wherein said removing means includes:

a circular array of flow passages in said back plate, said passages of circular array being spaced about a circle coaxial with said chamber and having a diameter less than the chamber diameter and greater than the maximum back plate recess diameter.

17. The apparatus of claim 16 wherein said delivering means slots have a length to hydraulic diameter ratio of at least 2.

18. The apparatus of claim 17 wherein the diameter of said throat does not exceed one-fourth the diameter of said vortex chamber.

19. The apparatus of claim 18 wherein the length of said throat is at least one-third the diameter of said throat whereby the accelerated vortex will become stabilized and of uniform thickness before being thinned in said diffuser.

20. The apparatus of claim 19 wherein said transmitting means includes a second circular array of passages which discharge into the manifold formed by said manifold defining means.

21. The apparatus of claim 1 wherein the fluid vortex attaches to the walls of said accelerating means, diffuser and throat defining means and wherein said diffuser includes:

an abrupt discontinuity in said smoothly curved wall, the vortex detaching from said wall at said discontinuity whereby a stable desired spray angle may be obtained.

22. The apparatus of claim 6 wherein the fluid vortex attaches to the walls of said accelerating means, diffuser and throat defining means and wherein said diffuser includes:

an abrupt discontinuity in said smoothly curved wall, the vortex detaching from said wall at said discontinuity whereby a stable desired spray angle may be obtained.

23. The apparatus of claim 7 wherein the fluid vortex attaches to the walls of said accelerating means, diffuser and throat defining means and wherein said diffuser includes:

an abrupt discontinuity in said smoothly curved wall, the vortex detaching from said wall at said discontinuity whereby a stable desired spray angle may be obtained.

24. The apparatus of claim 15 wherein the fluid vortex attaches to the walls of said accelerating means, diffuser and throat defining means and wherein said diffuser includes:

an abrupt discontinuity in said smoothly curved wall, the vortex detaching from said wall at said discontinuity whereby a stable desired spray angle may be obtained.

25. The apparatus of claim 20 wherein the fluid vortex attaches to the walls of said accelerating means, diffuser and throat defining means and wherein said diffuser includes:

an abrupt discontinuity in said smoothly curved wall, the vortex detaching from said wall at said discontinuity whereby a stable desired spray angle may be obtained.

* * * * *